US006387858B1

(12) United States Patent
Shah et al.

(10) Patent No.: US 6,387,858 B1
(45) Date of Patent: May 14, 2002

(54) SAFE TRANSPORT GEL FOR TREATING MEDICAL INSTRUMENTS

(75) Inventors: Sayed S. Shah; Shahin Keller; Mildred R. Bernando, all of St. Louis, MO (US)

(73) Assignee: Steris Inc., Temecula, CA (US)

( * ) Notice: Subject to any disclaimer, the term of this patent is extended or adjusted under 35 U.S.C. 154(b) by 0 days.

(21) Appl. No.: 09/540,950

(22) Filed: Mar. 31, 2000

(51) Int. Cl.[7] ..... C11D 3/37; C11D 3/48

(52) U.S. Cl. ..... 510/161; 510/220; 510/221; 510/233; 510/235; 510/403

(58) Field of Search ..... 510/161, 220, 510/221, 233, 235, 403

(56) References Cited

U.S. PATENT DOCUMENTS

| | | | | | |
|---|---|---|---|---|---|
| 3,578,499 | A | | 5/1971 | Crotty et al. | 134/4 |
| 3,659,712 | A | | 5/1972 | Lindner et al. | 252/99 |
| 3,825,069 | A | | 7/1974 | Norton et al. | 166/305 R |
| 3,912,450 | A | * | 10/1975 | Boucher | 21/54 A |
| 4,102,995 | A | | 7/1978 | Hebborn | 424/81 |
| 4,294,797 | A | | 10/1981 | Eibofner | 422/36 |
| 4,364,929 | A | | 12/1982 | Sasmor et al. | 424/80 |
| 4,788,242 | A | | 11/1988 | Takahashi et al. | 524/459 |
| 4,839,156 | A | | 6/1989 | Ng et al. | 424/53 |
| 4,891,216 | A | | 1/1990 | Kross et al. | 424/78 |
| 4,895,721 | A | | 1/1990 | Drucker | 424/53 |
| 4,923,677 | A | * | 5/1990 | Simon et al. | 422/37 |
| 5,158,761 | A | | 10/1992 | Kamishita et al. | 424/45 |
| 5,158,766 | A | | 10/1992 | Greenwald et al. | 424/78.33 |
| 5,208,010 | A | | 5/1993 | Thaler | 424/53 |
| 5,215,739 | A | | 6/1993 | Kamishita et al. | 424/45 |
| 5,326,492 | A | | 7/1994 | Hodam, Jr. | 252/106 |
| 5,348,678 | A | * | 9/1994 | Hodam, Jr. et al. | 252/106 |
| 5,489,531 | A | * | 2/1996 | Benson | 435/264 |
| 5,512,245 | A | | 4/1996 | Eibofner et al. | 422/28 |
| 5,597,791 | A | | 1/1997 | Richards et al. | 510/372 |
| 5,637,307 | A | | 6/1997 | Simmons et al. | 424/405 |
| 5,705,470 | A | | 1/1998 | Faris | 510/403 |
| 5,707,952 | A | | 1/1998 | Lambremont et al. | 510/362 |
| 5,726,138 | A | | 3/1998 | Tsaur et al. | 510/158 |
| 5,750,579 | A | | 5/1998 | Kamishita et al. | 514/772.6 |
| 5,756,437 | A | | 5/1998 | Yamazaki et al. | 510/136 |
| 5,810,944 | A | * | 9/1998 | Smitkowski et al. | 134/42 |
| 5,837,274 | A | | 11/1998 | Shick et al. | 424/406 |
| 5,900,256 | A | * | 5/1999 | Scoville, Jr. et al. | 424/616 |
| 5,910,529 | A | | 6/1999 | Wollner | 524/394 |
| 5,958,443 | A | | 9/1999 | Viegas et al. | 424/427 |
| 5,977,050 | A | * | 11/1999 | Faris | 510/403 |
| 5,998,342 | A | * | 12/1999 | Scoville, Jr. et al. | 510/160 |

* cited by examiner

*Primary Examiner*—Charles Boyer
(74) *Attorney, Agent, or Firm*—Fay, Sharpe, Fagan, Minnich & McKee, LLP

(57) ABSTRACT

A method for treating medical instruments after a surgical procedure, which leaves blood or other body fluid on the instrument, includes applying a gel composition that inhibits the fluid from drying on the instruments. The gel composition is preferably a low viscosity gel exhibiting both sufficient flow and coating characteristics. The viscosity is preferably from about 700 to about 4,000 centipoise (cps), preferably around 3,000 cps. Applying a gel to post-surgical medical instruments contains and keeps protein containing fluids moist for extended periods of time and facilitates subsequent transportation, cleaning, and sterilization of such instruments.

32 Claims, 1 Drawing Sheet

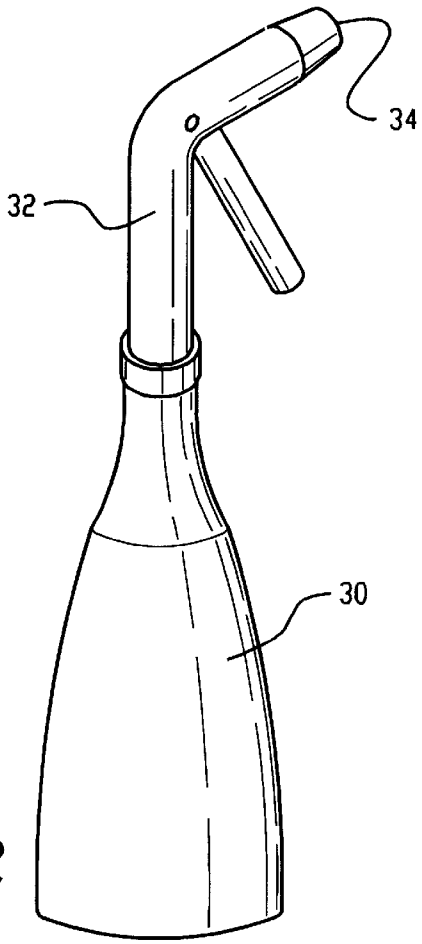
Fig. 2
Fig. 1
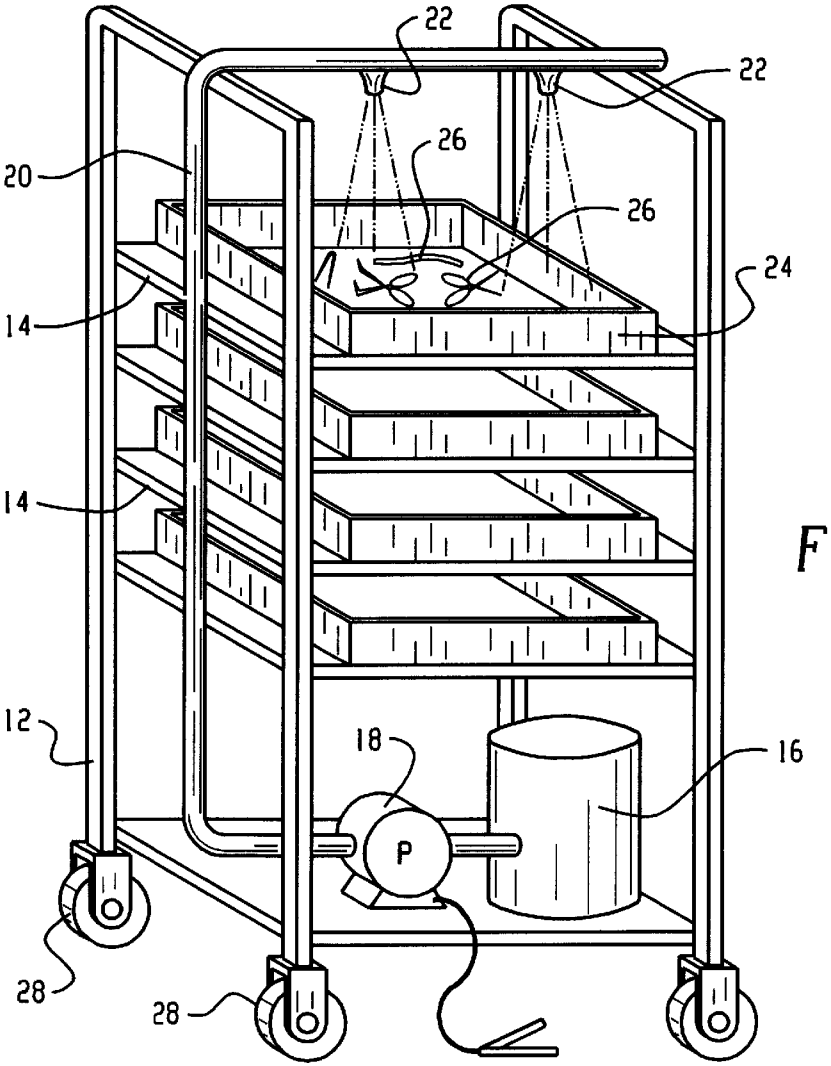

SAFE TRANSPORT GEL FOR TREATING MEDICAL INSTRUMENTS

BACKGROUND OF THE INVENTION

The present invention relates to the care of surgical instruments which come into contact with body fluids during use. It finds particular application in conjunction with the treatment of dental, surgical, veterinary and other medical instruments prior to cleaning and sterilization, and will be described with particular reference thereto. It should be appreciated, however, that the invention is applicable to a wide variety of equipment and pre-cleaning operations for removing protein or other contamination that becomes harder to remove with the loss of fluid content.

Medical devices are subjected to thorough cleaning and antimicrobial decontamination between each use. During surgery, the devices become coated with blood and other protein-rich body fluids which, if left to dry on the devices, form a hardened layer of biological residue that becomes difficult to remove in the cleaning process. Not only do such residues present a barrier to sterilant penetration, but in left in place, present a cleaning challenge for the automated washing cycles, and therefore, may require further cleaning by recycling through the automated washer, or may require a laborious manual cleaning step. Additionally, if not sufficiently removed after cleaning and sterilization, they may later break down to form toxic substances which pose hazards to patients when the devices are reused.

Immediately after a surgical procedure, therefore, the devices are often rinsed in a cleaning solution, such as an enzymatic cleaner, to remove the bulk of the blood, other body fluids and proteins from their surfaces. The rinsing process is generally carried out by immersing the devices in a shallow tray of the cleaning solution. Moreover, to minimize handling of contaminated instruments and to maintain the sterile zone around the surgical site and the surgeon and surgical nurses, the tray of cleaning fluid is prepared prior to surgery. The tray is open, posing hazards to personnel and equipment due to spillage. It also takes up valuable space in the operating theater, depending on the quantity and size of the instruments.

Disadvantages associated with soak cleaners include exposing workers to harmful microorganisms. Trays containing the soak cleaning solution and any contaminated instruments, are typically open, thereby exposing patients and workers to any biohazards present in the solution. Additionally, large trays are employed for treating large instruments and/or a significant number of instruments, and typically contain a relatively large volume of cleaning solution. Soaking involves complete immersion of contaminated instruments, entailing relatively large volumes of the soak cleaners. The heavy trays and large volumes make handling cumbersome for health care workers, and thereby increase the likelihood of spillage or sloshing. The additional weight presents challenges in safely relocating and transporting the heavy trays.

Foams are sometimes employed as a substitute to soak cleaners. Foams, such as a thin film of surfactant, are typically applied to instruments by spray methods. A disadvantage of foams is that the foam film collapses, thereby exposing the surface of the treated instrument to the atmosphere. Upon exposure to air, the fluid contained on the treated instrument dries out. Contaminants can also be released as the coated surface is re-exposed. Foams typically collapse in less than a half-hour. In the case of very stable foams, the film may last for about an hour before completely collapsing.

Although foams may be reapplied to a substrate, the short life of the film entails frequent monitoring to check foam stability. Having to reapply a foam at frequent intervals results in the use of larger quantities of a foam product.

There remains a need for a composition that will keep medical instruments moist, specifically keeping the soil or fluids contained thereon moist, to facilitate efficient cleaning in the subsequent cleaning steps. It is also desirable that a composition meeting the above requirement is easily applied to contaminated medical devices and can be used in relatively small quantities.

The present invention provides a new and improved method for post-operative treatment of medical instruments, and the like which overcomes the above-referenced problems and others.

SUMMARY OF THE INVENTION

In accordance with one aspect of the present invention, a method is provided for treating medical instruments after a surgical procedure which leaves blood or other body fluid on the instrument. The method includes applying a gel composition that inhibits the fluid from drying on the instrument.

In accordance with another aspect of the present invention, a method is provided for treating and cleaning a medical instrument contaminated with blood or other body fluid. The method includes applying a gel to surfaces of the medical instrument to form a gel film over the fluid, transporting the medical instrument to a cleaning station and cleaning the medical instrument. Applying sufficient gel film over the fluid inhibits the biological fluid from encrusting the instrument.

In accordance with a further aspect of the present invention, a composition is provided that is adapted to containing and maintaining fluids in a soluble state on contaminated medical instruments. The composition includes from about 0.1% to about 0.3% of a gel forming polymer, from about 0.1% to about 0.3% of neutralizing agent, from about 0.005% to about 0.01% of one or more corrosion inhibitors, from about 0% to about 14% of an antimicrobial agent, and the balance of the composition is water.

One advantage of the present invention is that it contains and keeps protein containing fluids moist for extended periods of time.

Another advantage of the present invention is that it provides for focused treatment of specifically contaminated areas of a medical instrument.

Another advantage of the present invention is that it facilitates ease of handling and treating medical instruments which are contaminated with blood or other body fluids.

A further advantage of the present invention is that it provides a method of treating medical instruments that facilitates relocation and transportation, prior to subsequent cleaning steps, by effectively reducing the weight associated with methods currently used for treating contaminated medical instruments.

Still another advantage of the present invention is that it inhibits blood or other fluids from drying out.

Another advantage of the present invention is that it encapsulates bioburdens and meets Occupational Safety and Health Association (OSHA) requirements.

Still further advantages of the present invention will become apparent on reading and understanding the following detailed description.

BRIEF DESCRIPTION OF THE FIGURES

The invention may take form in various components and arrangements of components, and in various steps and arrangement of steps. The drawings are only for purposes of illustrating preferred embodiments and are not to be construed as limiting the invention.

FIG. 1 is a perspective view of a system for post-operative pretreatment of medical instruments according to the present invention.

FIG. 2 is a perspective view of a trigger spray bottle for dispensing gel compositions used in the post-operative pretreatment of medical instruments according to the present invention.

DETAILED DESCRIPTION OF THE PREFERRED EMBODIMENTS

A gel composition is applied to instruments to keep surface contamination moist until it is removed in a subsequent cleaning operation. Specifically, the gel composition maintains soils and fluids, which remain on medical instruments after usage, in a fluid state and inhibits them from drying out.

The gel composition includes water, a polymer system, and preferably further includes one or more corrosion inhibitors, and one or more antimicrobial agents. Optionally the gel composition contains other ingredients, such as dyes, fragrances, and the like, as are described more fully herein.

The gel composition is either non-active or active. Active gel compositions differ from non-active compositions in that the gel composition contains an active ingredient providing the gel with an antimicrobial function, such as disinfection, towards microorganisms found in blood and other body fluids. Non-active gel compositions lack an active ingredient, but optionally contain preservatives.

The polymer system provides the gel composition with the desired gel consistency, i.e., viscosity. The polymer system includes a polymer and any additional components needed to activate the polymer. In one embodiment, the polymer system comprises a polymer and a neutralizing agent. For example, a polymer that is acidic in its free form exhibits little or no gel consistency. The neutralizing agent neutralizes the acidic polymer and produces a polymer system having a gel like nature.

Polymers suitable for use in the polymer system are gel forming, viscosity modifying polymers including, but not limited to, acrylic acid-based polymers, cellulose derivatives, gums, such as guars, guar derivatives, alginates, alginate derivatives, non-ionic surfactants, non-ionic polymers, and mixtures thereof. The polymer component is most preferably an acrylic acid-based polymer.

Examples of suitable acrylic acid-based polymers include but are not limited to those sold by B.F. Goodrich under the tradename Carbopol™ ETD™, including Carbopol™ ETD™ 2001, 2020, 2050, and 2623. Other exemplary commercially available acrylic acid-based polymers include Carbopol™ Aqua 30 and the Carbomer series including Carbopol™ 934, 940, 941, and 1342 available from B.F. Goodrich. Carbopol™ ETD™ 2623 has shown good stability in the gel composition.

Non-limiting examples of suitable cellulose derivatives include carboxy alkyl cellulose polymers and hydroxy alkyl cellulose polymers. Some commercially available cellulose derivatives include Natrosol™ 250, a hydroxyethyl cellulose, and Klucel™, a hydroxypropyl cellulose, both available from Aqualon.

Suitable non-ionic polymers include vinyl esters, vinyl ethers, vinyl alcohols, acrylamides, methacrylamides, alkyl or aryl acrylates alkyl or aryl methacrylates, alkyl or aryl maleates, acrylonitriles, vinyl pyrrolidone, polyalkenes, such as polymers of styrene, ethylene, or propylene, and multi-functional acids. Exemplary of non-ionic polymers are Laponite™ XLS and RDS™, which are synthetic sodium magnesium silicate polymers, available from Southern Clay Products.

Combinations of two or more suitable polymers are optionally employed to form a gel composition. Alginates, for example, are preferably used in combination with other polymer systems.

The neutralizing agent is any chemical that will sufficiently neutralize the polymer to form a gel. For acidic polymers, neutralizing agents are generally basic, such as triethanolamine (TEA), and alkali metal hydroxides, such as potassium hydroxide (KOH), sodium hydroxide (NaOH) an ammonium hydroxide ($NH_4OH$). The neutralizing agent is most preferably triethanolamine.

The polymer system also serves as a viscosity builder in the gel composition. The gel composition has a sufficient viscosity such that it coats the instruments and inhibits drying of the blood and body fluids, while allowing application of the gel composition by spraying, dipping, painting or other selected application methods. Viscosity is a property that affects methods of delivery and application. Viscosity indicates the flowability of a material. As the viscosity increases, a material exhibits reduced or limited flowability. Specifically, if the gel composition has a viscosity which is too high, it exhibits reduced flowability, which potentially-inhibits delivery or application of t gel. Excessive viscosity adversely affects its ability to wet surfaces and penetrate crevices and areas where parts meet. If the viscosity is very low, the gel flows off the instruments leaving only a thin coating. The viscosity of the gel composition is preferably from about 700 to about 4,000 centipoise (cps), more preferably from about 1,000 to about 3,500 cps, and most preferably from about 1,500 to 3,000 cps.

Compositions having viscosities in excess of 4,000 cps exhibit reduced flowability, which may limit certain application and delivery methods. Application and delivery methods are described more fully herein.

The components of the polymer system are present in sufficient concentration to provide the gel with the desired viscosity. The optimum amount of polymer present in the formulation depends on whether the gel is non-active or active, and on the type of polymer used. For many polymer systems, the gel composition has a polymer concentration from about 0.05% to about 3%. All percentages, unless otherwise noted, refer to percentage by weight. In non-active formulations, the concentration of the polymer is preferably from about 0.05% to about 1%, more preferably from about 0.075% to 0.50% and most preferably from about 0.1% to about 0.3%. In active-based gels, the polymer concentration is preferably from about 0.05% to about 14%, more preferably from about 0.75% to about 2% and most preferably from about 0.1% to about 1.5%.

The concentration of the neutralizing agent is preferably in the same range as the polymer concentration and most preferably equal or about equal to that of the polymer concentration. In non-active formulations containing carbopol polymers, the concentration of the neutralizing agent is preferably from about 0.05% to about 1%, more preferably from about 0.075% to about 0.5% and most preferably from about 0.1% to about 0.3%. In active-based formulations, the concentration of the neutralizing agent is preferably from about 0.05% to about 14%, more preferably from about 0.075% to 2%, and most preferably from about 0.1% to about 1.5%.

In the presence of water, blood, or corrosive fluids, metal substrates begin to corrode instantaneously. The gel composition, therefore, preferably comprises one or more corrosion inhibitors. Corrosion inhibitors are selected in accordance with the nature of the materials in the metal substrate. It is therefore preferable to have one or more corrosion inhibitors in the gel composition, such that the gel may be applied on a variety of metal substrates. Corrosion inhibitors are present at sufficient concentrations to inhibit corrosion of the medical instruments or other devices during the period of exposure to the gel composition.

Preferred corrosion inhibitors include phosphates, phosphonic acids, sulfates and borates, which are corrosion inhibitors for steel substrates. Suitable phosphates include alkali metal phosphates, such as those of sodium and potassium. Other examples of suitable phosphates include monosodium phosphate, disodium phosphate, sodium hexametaphosphate, and potassium equivalents thereof. Sodium hexametaphosphate serves as a chelating agent for water hardness salts, and the like, and is therefore useful in the composition.

A preferred corrosion inhibitor for steel substrates is a hydroxyethylidine di-phosphonic acid, sold under the tradename Dequest™ 2016 by Solutia Inc.

Corrosion inhibitors for steel are preferably present in the gel composition at concentrations of from about 0.005% to about 1.0%, more preferably from about 0.0065% to about 0.1%, and most preferably from about 0.007% to about 0.01%.

Exemplary aluminum corrosion inhibitors include 8-hydroxyquinoline and orthophenylphenol. Preferred copper and brass corrosion inhibitors include, benzoates, other five-membered ring compounds, azoles such as benzotriazoles, tolyltriazoles, mercaptobenzothiazole, and the like. A most preferred copper and/or brass corrosion inhibitor is sodium tolyltriazole.

The concentration of the copper and brass corrosion inhibitor is preferably from about 0.002% to about 0.1%, and most preferably from about 0.005% to about 0.01%.

In one embodiment, the gel composition includes an active ingredient which exhibits an antimicrobial function, such as sanitizing, disinfecting, or sterilizing. Sanitizing connotes preventing fungal growth and actively working against some types of bacteria. Disinfecting connotes killing or removing pathogenic microorganisms. Sterilizing connotes killing all microorganisms, including bacterial endospores, which are the living organisms most resistant to known sterilants.

The antimicrobial agent in the gel need not provide complete sterilization or disinfection during the time of contact. Rather, the antimicrobial agent helps to reduce human exposure to microorganisms. The gel preferably reduces exposure and facilitates disinfection prior to additional intensive cleaning and sterilization procedures.

Active gel compositions optionally include preservatives in addition to other antimicrobial agents. The active component in an active-based gel is preferably selected from the group including, but not limited to, hydrogen peroxide ($H_2O_2$), hydroxy acetic acid, perhydroxy acetic acid, peroxy acetic acids, phenols, Triclosan™ and chlorohexidine gluconate. Suitable peroxy acetic acids include peracetic and performic acid. It is also contemplated that combinations of two or more active ingredients may be employed in the gel composition. A preferred combination of active ingredients is hydrogen peroxide and peracetic acid.

The antimicrobial agent is present in quantities sufficient to achieve a desired level of antimicrobial treatment of the instruments. For example, higher concentrations are used to provide sterilization, while lower concentrations are appropriate for disinfecting or sanitization. In the case of hydrogen peroxide and peracetic acid, the active ingredients are preferably present at a total concentration from about 2% to about 20%, most preferably from about 3% to about 17% and most preferably from about 5% to about 15%. It is preferable when two or more active ingredients are employed that the combined concentration of active ingredients falls within the above specified ranges.

The concentration range of other ingredients, such as neutralizing agents and corrosion inhibitors is broadened in active gel compositions. In active gels, neutralizing agents are preferably in the range from about 0.1% to about 14%, and corrosion inhibitors are preferably present in the concentrations from about 0.2% to about 1.0% for steel corrosion inhibitors and from about 0.02% to about 1.0% for copper and brass corrosion inhibitors.

In another preferred embodiment, the gel composition is non-active, i.e., the gel has minimal or no activity as a typical disinfectant. Preferably, the non-active gel composition includes a preservative. Preservatives function to prevent fungal growth and work against some common bacteria. Preferably, the preservative has efficacy against some bacteria, which include *Aspergillus niger, Candida albicans, Escherichia coli, Pseudomonas aeruginosa*, and *Staphylococcus aureus*.

Some preferred preservatives include but are not limited to benzoic acid, benzoic acid derivatives, phenols, quaternary ammoniums, Dowicil™, and DMDM Hydantoin. Other non-limiting examples of suitable preservatives are those described and listed in greater detail in "Cosmetics," Kirk-Othmer Encyclopedia of Chemical Technology, 4th Edition, Vol. 7, 582–585 (1995). A preferred preservative is DMDM Hydantoin.

Preservatives are preferably present in concentrations from about 0.1% to about 0.4%, more preferably from about 0.2% to about 0.35%, and most preferably from about 0.25% to about 0.3%.

The gel composition preferably includes a surface energy reducing agent or wetting agent ("surfactant") to increase penetration into crevices of items being treated. This is particularly important when cleaning and decontaminating complex medical instruments which may contain microbial contaminants in crevices, joints, and lumens. In non-active compositions, surfactants facilitate cleaning in a subsequent pre-wash phase, such as when cleaning occurs in an automated washer. The pre-wash phase is typically a rinsing step intended to remove gross debris from the instrument. Rinsing typically involves spraying cold or warm water onto the instruments. The pre-wash phase typically does not employ the use of detergents or cleaning agents. However, surfactants in the gel composition, coated on the soiled instruments, penetrate the surface of dirt and debris and help break up and remove the soils in the pre-wash phase.

Surface energy reducing agents include anionic, cationic, non-ionic, amphoteric, and/or zwitterionic surfactants. Specific classes of wetting agents which are useful include anionic and non-ionic surfactants or combinations thereof. Examples of non-ionic wetting agents include fatty alcohol polyglycol ethers, nonylphenoxypoly (ethyleneoxy) ethanol, a non-ionic surfactant, and ethoxylated polyoxypropylene, a non-ionic surfactant. Specific examples include Genapol UD-50™, Igepal™ (nonylphenoxypoly (ethyleneoxy) ethanol), Fluowet™, Antarox™ (ethoxylated polyoxypropylene), and Pegol™. The wetting agents set forth above or others may be used alone or in combination with each other.

In cases where the instruments are to be washed in an automated washer, surfactants used in the gel compositions are preferably low-foaming surfactants, such as non-ionic and amphoteric surfactants. A preferred surfactant is a mixed CB amphocarboxylate.

High-foaming surfactants, such as anionic surfactants, are also suitable in gel composition. Gel compositions having high-foaming surfactants find application in situations where soiled instrumentation, treated with the gel composition, is not to be cleaned in an automated washer.

Surfactants are preferably present in the gel compositions at concentrations from about 0.05% to about 1.0%, more preferably from about 0.05% to about 0.5%, and most preferably from about 0.08% to about 0.2%.

The gel compositions, including both non-active and active gels, preferably include other "cosmetic" chemicals. Non-limiting examples of such "cosmetic" chemicals include dyes and perfumes.

Water soluble dye may be added to the gel composition such FD and C Blue 1 dye. Red dye can be added to provide a warning that the instruments covered with the gel should be treated as biohazardous.

The concentration of a dye solution in the gel composition is dependent on the dye and the degree of color desired. In general, the gel composition preferably has a dye concentration in the range from about 0.001% to about 0.005%, and most preferably from about 0.002% to about 0.004%.

Dyes are not an essential component in gel compositions. However, when added to an otherwise clear gel composition, the dye enhances the visibility of the gel to the user and allows the user to determine visually if there is sufficient gel coverage to contain fully and moisten residual fluids, on contaminated instruments.

Optionally, perfumes and fragrances are included in the gel compositions. The term fragrance as used herein, refers to any perfume or fragrance. The fragrance is added to mask any odors associated with soiled or contaminated instruments, such as odors from blood or other body fluids. Suitable fragrances are preferably water soluble.

The concentration of the fragrance in the gel composition depends on the type of fragrance added and the desired degree of fragrant odor. However, fragrances are optionally present in concentrations of from about 0.02% to about 0.045%, and most preferably from about 0.03% to about 0.04%.

The balance of the gel composition comprises water, preferably in the range from about 97% to about 99.2%. Preferably, deionized water or other purified water is used in the gel composition, but tap water may also be utilized.

The gel composition preferably has a pH of at least 5, preferably around neutral, i.e., around 7. Specifically, the pH is preferably from about 6.5 to about 7.5, more preferably from about 6.8 to about 7.2, and most preferably about 7.0. A gel having a neutral, or near neutral pH, is less corrosive to instruments. Preferably, the selected pH is one at which the antimicrobial agent is active.

Exemplary of a non-active composition is a gel comprising from about 0.05% to about 3% of one or more polymers, from about 0.05% to about 3% of a neutralizing agent, from about 0.005% to about 1.0% of one or more corrosion inhibitors, from about 0.1% to about 0.4% of an antimicrobial agent including a preservative, from about 0.05% to about 1.0% of a surfactant, from about 0.001% to about 0.005% of a dye, from about 0.02% to about 0.045% of a fragrance, and the balance of the gel composition comprising water.

Exemplary of an active-based composition is a gel comprising from about 0.05% to about 3% of one or more polymers, from about 0.1% to about 14% of a neutralizing agent, from about 0.02% to about 1.0% of one or more corrosion inhibitors, from about 0.1% to about 0.4% of an antimicrobial agent exhibiting a disinfecting and/or sterilizing function, from about 0.05% to about 1.0% of a surfactant, from about 0.001% to about 0.005% of a dye, from about 0.02% to about 0.045% of a fragrance, and the balance of the gel composition comprising water.

Gel compositions are formed by mixing the desired components in the amounts previously specified herein. Upon formation, gel compositions may be used immediately or stored for later use.

In one embodiment of an active-based gel, the antimicrobial agent is formed by reaction of two or more reactants. For example, perhydroxy acetic acid, an antimicrobial agent, is formed in situ by combining hydrogen peroxide and hydroxy acetic acid. As another example, peracetic acid is formed from acetyl salicylic acid and a perborate, such as sodium perborate.

The gel composition is especially suited for a post-operative treatment step for medical, dental, mortuary, or pharmaceutical instruments and/or devices, prior to cleaning and decontamination. The gel composition provides a means for keeping the blood and other protein-rich body fluids, which are present on soiled medical instruments after a surgical procedure, moist for extended periods of time.

The gel composition keeps blood or other body fluids moist for several hours, typically about three to four hours, and up to eight hours in some cases, which in most instances is sufficient to transport the instrument to a washing system. Water in the gel composition interacts with the fluids on the instrument to solubilize and keep the blood and other biological fluids moist. The length of time in which fluids are kept moist by the gel is dependent on the thickness of the applied gel film. Thicker gel films result in longer periods of time before drying. In typical applications, the exposed surface of a gel film begin to skin over or dry first, often in about two to about four hours, while the remaining gel remains wet. Preferably, the gel compositions last over eight hours before completely drying out.

Additionally, the gel composition entrains and coats bioburdens and reduces exposure of microorganisms to health care workers. Exposure is further reduced when active based disinfecting gels are utilized.

The gel composition is applied to the instruments by any suitable dispenser for dispensing liquid or gel compositions. Exemplary dispensers include trigger spray bottles, pump spray containers, pressurized spray cans, squeeze bottles, and spray devices utilizing a compressed air pump. An exemplary method of applying the gel composition to the instrument includes spraying. Other methods of application include dipping the instruments in the gel composition or painting the gel composition with a brush or other application. The method includes treating surgical instruments such that blood or body fluids remaining on post-surgical instruments do not dry out.

The method includes treating one or more contaminated post-surgical medical instruments by applying a gel composition, such as the gel previously described herein, to the instrument, transporting the treated instruments coated with the applied gel composition to a cleaning station, and cleaning and preferably sterilizing the treated medical instruments.

Specifically, the treatment step comprises applying the gel composition to any region of the contaminated instrument coated with blood or contaminated with other body fluids. The gel forms a gel film over the fluid region and interacts with the blood and/or fluid, to keep the fluid soluble and moist. The gel composition may be applied to either the entire surface of a contaminated instrument or to one or more localized contaminated regions. A contaminated region as used herein refers to any area of a medical or other instrument, including a surface or a crevice, containing blood and/or any other body fluid. In either application, a sufficient amount of gel composition is preferably applied such that all contaminated regions are sufficiently coated with the gel composition to contain the fluid and keep it moist until cleaning takes place: The gel composition is preferably applied to one or more localized contaminated regions, more preferably to the entire surface of the instrument.

The treatment step includes dispensing a gel composition onto a contaminated medical instrument via any suitable method for dispensing liquid or gel solutions. Exemplary of a suitable application method is spraying. Suitable dispensers include a trigger spay bottle, a spray container, pressurized spray cans, squeeze bottles and any spray method utilizing a compressed air pump.

Optionally, other post-operative cleaning processes are used prior to or after the use of the gel composition. For example, a liquid cleaner may be used to treat internal passages of instruments, or the instruments may be soaked in a liquid cleaner, such as an enzymatic cleaner.

With reference to FIG. 1, one embodiment of a method for post-operative pretreatment of medical instruments employs a system 10. A moveable cart 12 has a plurality of shelves 14 equipped to house the system components. The system components include a supply container 16, which contains the gel composition; a pump 18; a dispensing tube 20; spray nozzles 22 attached at the end of each tube; and a tray 24, for receiving medical instruments.

The pump 18, controlled with a foot switch or other suitable switch, forces the gel composition out of the supply container 16 and into each of the dispensing tubes 20. The gel composition is pumped through the tubes and into the spray nozzles 22. The gel composition exits spray nozzles 22 and is sprayed over the instruments 26 placed in the tray 24. Optionally, the gel composition may be applied to contaminated instruments prior to placing them into the tray.

Any number of dispensing tubes may be employed in a pretreatment system. The number of tubes employed is determined by factors including the size of the work area and the efficiency of the pump. The number of dispensing tubes is sufficient to allow coverage of medical instruments in the tray, and such that the pump can provide a constant and/or uniform flow of the gel composition through each tube.

In a preferred embodiment, the tray 24 is removable from the cart. A removable tray provides a transportation option in that it conveys instruments to a cleaning station. Additionally, a removable tray containing treated post-surgical instruments may be moved in order to provide space for other trays containing untreated instruments. Additionally, removable trays containing treated instruments may be moved to another apparatus or cart suitable for transporting the treated instruments to a cleaning station. Trays containing treated instruments may optionally be moved and/or stored for extended time periods prior to being transported to a cleaning station.

Cart 12 is preferably equipped with wheels 28, rollers, casters, or the like. This allows the cart to be easily moved within the operating theater and also provide a means for transporting the cart and any treated instruments contained thereon to a cleaning station for subsequent cleaning and sterilization.

With reference to FIG. 2, another embodiment of a method for post-operative pretreatment of medical instruments employs a spray bottle for dispensing the gel composition. Pump 32 pumps the gel composition, contained in supply container 30, through a tube (not shown) and into a spray nozzle 34. The gel composition exits spray nozzle 34 and is sprayed onto contaminated instruments. Instruments are preferably stored in a tray, such as, for example, tray 24 of FIG. 1, until the time they are transported to a cleaning station.

The treated instruments are preferably transported to a cleaning station shortly after application of the gel composition. The maximum time between application and transportation depends on both the amount and type of gel applied to contaminated regions and the nature of the contaminants. Typically, longer periods of time may elapse between application and transportation when thicker gel films are applied. Optionally, additional gel may be applied to a contaminated region if desired. For example, where a washer is not available for cleaning the instruments, applying additional gel, such that a fluid does not dry out, increases the time which may elapse prior to subsequent cleaning.

Preferably, the gel film resides on the treated instrument, in a gel like state, until the cleaning and/or microbial decontamination process. During cleaning the gel and any soils, blood, or other fluids are removed from the instrument surface. The gel composition, specifically, the surfactants contained therein, facilitates cleaning and removal of debris during the cleaning process.

Cleaning and sterilization is accomplished by any known method in the art. Cleaning, for example, may be accomplished in an automated washer using suitable detergents. Sterilization may be accomplished after the wash cycle by exposing the instrument to a sterilizing agent, such as, for example, peracetic acid, hydrogen peroxide, and the like. Sterilization may also be suitably accomplished by steam sterilization methods.

The method is suitable for treating any type of instrument that may contact or retain blood or other body fluid after usage. Some non-limiting examples of instruments include scalpels, scissors, endoscopes, forceps, catheters, retractors, clamps, spatulas, and the like.

Keeping fluids moist reduces problems associated with cleaning medical instruments containing dried out or polymerized biological residue. The residues present barriers to sterilant penetration and/or break down to form toxic substances, which may pose hazards to patients when instruments are later reused.

Using the minimal amount of gel required to sufficiently coat, contain, and prevent fluids from drying reduces treatment costs and avoids problems associated with other treatment methods. Specifically the use of gel compositions reduces exposure resulting from sloshing and cumbersome handling of contaminated instruments associated with soak cleaning and short term containment associated with foams.

Without intending to limit the scope of the invention, the following examples provide suitable formulations of the composition.

EXAMPLES

Example 1

The following non-active gel composition, intended for surgical instruments containing bio burdens as a pre-cleaning operation for medical instruments, was prepared:

| Materials | Function | % by Weight |
|---|---|---|
| Carbopol ETD 2623 | Polymer | 0.200 |
| Triethanolamine | Neutralizing agent | 0.224 |
| Hydroxyethylidene di-phosphonic acid | Steel corrosion inhibitor | 0.008 |
| Sodium tolytriazole | Copper and brass corrosion inhibitor | 0.0060 |
| DMDM hydantoin | Preservative (antimicrobial) | 0.300 |
| Mixed $C_8$ amphocarboxylate | Surfactant | 0.100 |
| FD&C Blue #1 dye | Dye | 0.0030 |
| Floral Citrus Fragrance | Fragrance | 0.0380 |
| Water | | 99.121 |

Example 2

The following is an example of an active-based gel composition:

| Materials | Function | % by Weight |
|---|---|---|
| Carbopol ETD 2623 | Polymer | 0.22 |
| Oxy-Rite 100 | Stabilizer | 0.02 |
| Dequest 2016 | Corrosion Inhibitor | 0.11 |
| Hydrogen peroxide (35% act. vc) | Antimicrobial | 17.4 |
| Potassium hydroxide | Neutralizing Agent | 0.12 |
| Mixed (8 amphocarboxylate | Surfactant | 0.11 |
| Deionized water | | Balance |

Example 3

The following is an example of an active-based gel composition employing a combination of antimicrobial agents.

| Materials | Function | % by Weight |
|---|---|---|
| Carbopol ETD 2623 | Polymer | 1.0–1.5 |
| Hydrogen peroxide | Antimicrobial | 2.0–3.0 |
| Peroxy acetic acid | Antimicrobial | 2.0–3.0 |
| Hydroxy acetic acid | Antimicrobial | 1.0–7.0 |
| Triethanolamine | Neutralizing Agent | 1.0–14.0 |
| Dequest 2010 | Steel corrosion inhibitor | 0.5 |
| Sodium tolytriazol | Copper and brass corrosion inhibitor | 0.05 |
| Water | | Balance |

Example 4

The following example compares the stability of foams to gel compositions.

A foam was applied to a 3"×5" steel panel. Additionally, a gel composition, as described in Example 1, was applied to a separate 3"×5" steel panel. The gel composition was applied such that it had a thickness equal to or less than about 3 mm to about 4 mm. The foam was applied such that it had a thickness equal to about 5 mm to about 10 mm.

The time required for drying and/or collapse of both the foam and gel films was monitored. The foam collapsed and dried out in less than one hour. However, after four hours, only about 10% of the gel composition dried. The dried out portion of the gel occurred around the periphery or edges of the gel film. The remaining portion of the gel was still wet. The gel completely dried in about eight hours.

The invention has been described with reference to the preferred embodiments. Modifications and alterations will occur to others upon a reading and understanding of the preceding detailed description. It is intended that the invention be construed as including all such modifications insofar as they come within the scope of the appended claims or the equivalents thereof.

Having thus described the preferred embodiments, the invention is now claimed to be:

1. A method of treating a medical instrument after a surgical procedure which leaves blood or other body fluid on the instrument, the method comprising:

spraying a gel composition over surfaces of the instrument that inhibits the fluid from drying on the instrument, the gel forming a skin over the surfacer of the instrument which keeps the blood or other body fluid moist for at least four hours.

2. The method according to claim 1, wherein the gel composition includes a sufficient amount of a polymer system to provide the gel composition with a viscosity from about 700 to about 4,000 cps.

3. A method of treating a medical instrument after a surgical procedure which leaves blood or other body fluid on the instrument, the method comprising:

applying a gel composition that inhibits the fluid from drying on the instrument for four or more hours, the viscosity of the gel composition being from about 1,000 to about 3,500 cps.

4. The method according to claim 3, wherein the viscosity of the gel composition is from about 1,500 to about 3,000 cps.

5. The method according to claim 2, wherein the polymer system includes a polymer from the group consisting of acrylic acid-based polymers, cellulose derivatives, gums, guars, guar derivatives, alginates, alginate derivatives, non-ionic surfactants, non-ionic polymers, and combinations thereof.

6. The method according to claim 5, wherein the polymer includes an acrylic acid-based polymer.

7. The method according to claim 6, wherein the polymer system further comprises a neutralizing agent including one or more of the group consisting of triethanolamine, potassium hydroxide, sodium hydroxide, and ammonium hydroxide.

8. The method according to claim 1, wherein the gel composition includes an antimicrobial agent.

9. The method according to claim 8, wherein the antimicrobial agent includes an active agent which is present in a sufficient amount to kill at least a portion of any microorganisms present in the fluids.

10. The method according to claim 8, wherein the antimicrobial agent includes a preservative, which inhibits microbial growth during storage of the gel.

11. The method according to claim 10, wherein the preservative includes one or more of the group consisting of benzoic acid, benzoic acid derivatives, phenols, quaternary ammoniums, Dowicil, DMDM Hydantoin, and combinations thereof.

12. The method according to claim 9, wherein the active agent is selected from the group consisting of hydrogen peroxide, hydroxy acetic acid, perhydroxy acetic acid, phenols, triclosan, chlorohexidine gluconate, peracetic acid, performic acid, and combinations thereof.

13. A method of treating a medical instrument after a surgical procedure which leaves blood or other body fluid on the instrument, the method comprising:

applying a gel composition that is capable of inhibiting the fluid from drying on the instrument for a period of four hours, the gel composition including:

a polymer selected from the group consisting of acrylic acid-based polymers, cellulose derivatives, gums, guars, guar derivatives, alginates, alginate derivatives, non-ionic surfactants, non-ionic polymers, and combinations thereof, and a low-foaming surfactant selected from the group consisting of non-ionic and amphoteric surfactants, the composition being free of high-foaming surfactants.

14. The method according to claim 1, wherein the gel composition is applied to one or more localized contaminated regions containing a fluid, to sufficiently form a film over the fluid.

15. The method according to claim 3 wherein the step of applying the gel composition includes spraying the gel composition over the medical instrument.

16. The method according to claim 1, wherein the gel composition includes a corrosion inhibitor.

17. The method according to claim 16, wherein the corrosion inhibitor is selected from the group consisting of monosodium phosphate, disodium phosphate, sodium hexametaphosphate, hydroxyethylidiene di-phosphonic acid, sulfates, borates, benzoates, benzotriazoles, mercaptobenzothiazoles, sodium tolyltriazoles, and combinations thereof.

18. The method according to claim 17, wherein the corrosion inhibitor includes hydroxyethylidine di-phosphonic acid and sodium tolyltriazole.

19. The method according to claim 1, wherein the gel composition further includes a dye in sufficient amount to render the gel composition visible on the instrument.

20. The method according to claim 1, wherein the gel composition includes:

from about 0.05% to about 3% of one or more polymers;

from about 0.05% to about 3% of a neutralizing agent;

from about 0.002% to about 1.0% of one or more corrosion inhibitors;

from about 0.1% to about 0.4% of a preservative; and water.

21. The method according to claim 3, wherein the gel composition includes:

from about 0.1% to about 0.3% of a gel forming polymer;

from about 0.1% to about 3.0% of a neutralizing agent;

from about 0.005% to about 0.01% of one or more corrosion inhibitors;

from about 0% to about 14% of an antimicrobial agent;

water; and a viscosity adjusting agent which adjusts the viscosity to 1000 to 3,500 cps.

22. The method according to claim 21, wherein the gel forming polymer is selected from the group consisting of acrylic acid-based polymers, cellulose derivatives, gums, guars, guar derivatives, alginates, alginate derivatives, non-ionic surfactants, non-ionic polymers, and combinations thereof.

23. The method according to claim 21, wherein the neutralizing agent is selected from the group consisting of triethanolamine, potassium hydroxide, sodium hydroxide, ammonium hydroxide, and combinations thereof.

24. The method according to claim 21, wherein the antimicrobial agent includes a preservative selected from the group consisting of benzoic acid, benzoic acid derivatives, phenols, quaternary ammoniums, Dowicil, DMDM Hydantoin, and combinations thereof.

25. The method according to claim 23, wherein the composition includes from about 0.1% to about 0.3% of the neutralizing agent.

26. The method according to claim 21, wherein the antimicrobial agent includes an active agent selected from the group consisting of hydrogen peroxide, hydroxy acetic acid, perhydroxy acetic acid, phenols, triclosan, chlorohexidine gluconate, peracetic acid, performic acid, and combinations thereof.

27. The method according to claim 26, wherein the composition includes from about 0.1% to about 14.0% of the antimicrobial agent.

28. The method according to claim 21, wherein the corrosion inhibitor is selected from the group consisting of monosodium phosphate, disodium phosphate, sodium hexametaphosphate, hydroxyethylidiene di-phosphonic acid, sulfates, borates, benzoates, benzotriazoles, mercaptobenzothiazoles, sodium tolyltriazoles, and combinations thereof.

29. The method according to claim 21, wherein the gel forming polymer is selected from the group consisting of acrylic acid-based polymers, cellulose derivatives, and combinations thereof; the neutralizing agent is selected from the group consisting of triethanolamine, potassium hydroxide, and combinations thereof; the antimicrobial agent includes a preservative selected from the group consisting of quaternary ammoniums, phenols, DMDM Hydantoin, and combinations thereof; and the corrosion inhibitor is selected from the group consisting of hydroxyethylidene di-phosphonic acid, sodium tolyltriazole, and combinations thereof.

30. A method for treating and cleaning a medical instrument contaminated with blood or other body fluid, the method comprising:

applying a gel to surfaces of the medical instrument to form a gel film over biological fluid, and inhibit the biological fluid from encrusting the instrument, the gel including:

0.1% to 3% of a water soluble polymer;

0.0% to 3% of a neutralizing agent;

0.0002 to 1.0% corrosion inhibitor;

0.0% to 14% antimicrobial agent; and a viscosity adjusting agent which adjusts viscosity to 1,000 to 3,500 cps, the gel being capable of keeping the biological fluid on the medical instrument moist for at least four hours; transporting the medical instrument in the gel to a cleaning station; and cleaning the medical instrument.

31. The method according to claim 30, wherein the cleaning step includes washing the instrument with water and detergent.

32. The method according to claim 13, wherein the low-foaming surfactant includes a mixed $C_8$ amphocarboxylate.

* * * * *

UNITED STATES PATENT AND TRADEMARK OFFICE

CERTIFICATE OF CORRECTION

PATENT NO. : 6,387,858 B1
DATED : May 14, 2002
INVENTOR(S) : Shah et al.

It is certified that error appears in the above-identified patent and that said Letters Patent is hereby corrected as shown below:

Title page,
Item [75], please correct the listing of the Inventors as follows:

-- [75] Inventors: Sayed S. Shah; Shahin Keller; Mildred R. Bernardo, all of St. Louis, MO (US). --

Signed and Sealed this

Twenty-fourth Day of September, 2002

*Attest:*

*Attesting Officer*

JAMES E. ROGAN
*Director of the United States Patent and Trademark Office*